US006699914B2

(12) United States Patent
Hara et al.

(10) Patent No.: US 6,699,914 B2
(45) Date of Patent: Mar. 2, 2004

(54) WATER-REPELLENT COMPOSITION FOR FOAMING PROCESS

(75) Inventors: Ryosuke Hara, Settsu (JP); Tsukasa Aga, Settsu (JP); Fumihiko Yamaguchi, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/290,155

(22) Filed: Nov. 8, 2002

(65) Prior Publication Data

US 2003/0114547 A1 Jun. 19, 2003

(30) Foreign Application Priority Data

Nov. 9, 2001 (JP) ..... P2001-344075

(51) Int. Cl.[7] ..... C08J 9/30

(52) U.S. Cl. ..... 521/65; 521/72

(58) Field of Search ..... 521/65, 72

(56) References Cited

U.S. PATENT DOCUMENTS 5,601,910 A * 2/1997 Murphy et al.
5,763,040 A * 6/1998 Murphy et al.
6,358,660 B1 * 3/2002 Agler et al.

* cited by examiner

*Primary Examiner*—Morton Foelak
(74) *Attorney, Agent, or Firm*—Sughrue Mion, PLLC

(57) ABSTRACT

A water-repellent composition for foaming process of a hydrophobic textile, comprising (A) a dispersion of a fluorine-containing polymer, (B) a foaming agent, and (C) a wetting agent is suitable for water-repellent treatment of the hydrophobic textile and can give easy generation of sufficient foaming.

8 Claims, No Drawings

WATER-REPELLENT COMPOSITION FOR FOAMING PROCESS

FIELD OF THE INVENTION

The present invention relates to a water-repellent composition for foaming process of a hydrophobic textile (for example, a fabric), and a textile treated with said water-repellent composition.

RELATED ARTS

A textile is generally and widely processed for the purpose of imparting water-repellency and water resistance to the textile.

When the water-repellency and the water resistance are imparted to the textile, generally, a water-repellent agent is applied by a dip-nip method or a spray method and the textile is thermally treated.

In the dip-nip method, the textile is completely wetted so that a wet pick up is high and a subsequent thermal treatment requires a large amount of heat. In addition, a large quantity of the water-repellent treatment liquid is necessary so that excess amount of the water-repellent becomes a waste liquid.

In the spray method, the loss of the water-repellent treatment liquid is large, and this method has a problem in environmental health since fine mists waft during the treatment.

A foam process is widely conducted for a hydrophilic textile, since the treatment liquid easily penetrates into the textile. However, for a hydrophobic textile, a wetting agent which penetrates the treatment liquid into the textile is necessary. Many of the generally used wetting agent has an antifoaming effect and the foam process of the hydrophobic textile was difficult.

SUMMARY OF THE INVENTION

An object of the present invention is to provide a water-repellent composition for foaming process, which is suitable for a hydrophobic textile and easily generates sufficient foam.

The present invention provides a water-repellent composition for foaming process of a hydrophobic textile, comprising:

(A) a dispersion of a fluorine-containing polymer, (B) a foaming agent, and (C) a wetting agent.

The water-repellent composition of the present invention may further contain (D) a water-soluble polymer.

DETAILED EXPLANATION OF THE INVENTION

<Dispersion of Fluorine-containing Polymer (A)>

Generally, the dispersion of fluorine-containing polymer (A) is a dispersion of fluorine-containing polymer wherein a fluorine-containing polymer is dispersed in a liquid, for example, water and an organic solvent, in the presence of a surfactant. The dispersion is generally an emulsion.

The fluorine-containing polymer is a homopolymer or copolymer of a fluorine-containing monomer. The copolymer is a copolymer a fluorine-containing monomer and another monomer copolymerizable herewith.

The fluorine-containing monomer is generally a polymerizable compound having a perfluoroalkyl and perfluoroalkenyl group and an acrylate or methacrylate group. In the copolymer of the fluorine-containing monomer, the amount of the fluorine-containing monomer is at least 40% by weight, preferably at least 60% by weight, based on whole of the copolymer.

Examples of the polymerizable compound having the perfluoroalkyl and perfluoroalkenyl group and the acrylate or methacrylate group are as follows:

(1)

$$Rf-SO_2-\overset{\overset{\displaystyle R^1}{|}}{N}R^2OCOCR^3{=}CH_2$$

(2)

$$Rf-(CH_2)_nOCOCR^3{=}CH_2$$

(3)

$$Rf-CO-\overset{\overset{\displaystyle R^1}{|}}{N}R^2OCOCR^3{=}CH_2$$

(4)

$$Rf-CH_2\overset{\overset{\displaystyle OH}{|}}{C}HCH_2OCOCR^3{=}CH_2$$

(5)

$$Rf-CH_2\overset{\overset{\displaystyle OCOR^3}{|}}{C}HCH_2OCOCR^3{=}CH_2$$

(6)

$$Rf-O-Ar-CH_2OCOCR^3{=}CH_2$$

wherein Rf is a perfluoroalkyl or perfluoroalkenyl group having 3 to 21 carbon atoms, $R^1$ is a hydrogen atom or an alkyl group having 1 to 10 carbon atoms, $R^2$ is an alkylene group having 1 to 10 carbon atoms, $R^3$ is a hydrogen atom or a methyl group, Ar is an aryl group which optionally has a substituent group, and n is an integer of 1 to 10.

Specific examples of the polymerizable compound include the followings:

$CF_3(CF_2)_7(CH_2)OCOCH{=}CH_2$ $CF_3(CF_2)_6(CH_2)OCOC(CH_3){=}CH_2$ $(CF_3)_2CF(CF_2)_6(CH_2)_2OCOCH{=}CH_2$ $CF_3(CF_2)_7(CH_2)_2OCOC(CH_3){=}CH_2$ $CF_3(CF_2)_7(CH_2)_2OCOCH{=}CH_2$ $CF_3(CF_2)_7SO_2N(CH_3)(CH_2)_2OCOCH{=}CH_2$ $CF_3(CF_2)_7SO_2N(C_2H_5)(CH_2)_2OCOC(CH_3){=}CH_2$ $(CF_3)_2CF(CF_2)_6CH_2CH(OCOCH_3)CH_2OCOC(CH_3){=}CH_2$ $(CF_3)_2CF(CF_2)_6CH_2CH(OH)CH_2OCOCH{=}CH_2$

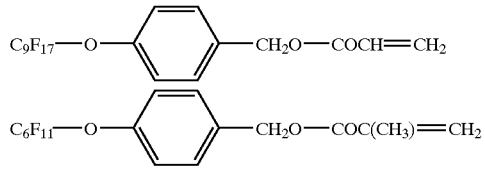

The another copolymerizable compound are various. Examples of the another copolymerizable compound include: (1) acrylic acid and methacrylic acid, and methyl, ethyl, butyl, isobutyl, t-butyl, propyl, 2-ethylhexyl, hexyl, decyl, isodecyl, lauryl, stearyl, isostearyl, isobornyl, β-hydroxyethyl, glycidyl, phenyl, benzyl and 4-cyanophenyl esters thereof; (2) vinyl esters of fatty acids such as acetic acid, propionic acid, caprylic acid, lauric acid and stearic acid; (3) styrene compounds such as styrene, α-methylstyrene and p-methylstyrene; (4) vinyl halides and vinylidene compounds such as vinyl fluoride, vinyl chloride, vinyl bromide, vinylidene fluoride and vinylidene chloride; (5) fatty acid allyl esters such as allyl heptanoate, allyl caprylate and allyl caproate; (6) vinyl alkyl ketones such as vinyl methyl ketone and vinyl ethyl ketone; (7) acryl amides such as N-methylacrylamide and N-methylolmethacrylamide; and (8) dienes such as 2,3-dichloro-1,3-butadiene and isoprene.

The surfactant which is used for dispersing the polymer may be any of a nonionic surfactant, an anionic surfactant and a cationic surfactant.

The surfactant may comprise a combination of the cationic surfactant and the nonionic surfactant.

The cationic surfactant includes dodecyl trimethyl ammonium acetate, trimethyl tetradecyl ammonium chloride, hexadecyl trimethyl ammonium bromide, trimethyl octadecyl ammonium chloride (stearyl trimethyl ammonium chloride), behenyl trimethyl ammonium chloride, (dodecylmethylbenzyl) trimethyl ammonium chloride, didodecyl dimethyl ammonium chloride, dioctadecyl dimethyl ammonium chloride, benzyl dodecyl dimethyl ammonium chloride, benzyl tetradecyl dimethyl ammonium chloride, benzyl octadecyl dimethyl ammonium chloride, methyl dodecyl di(hydropolyoxyethylene) ammonium chloride, benzyl dodecyl di(hydropolyoxyethylene) ammonium chloride and N-[2-(diethylamino)ethyl]oleamide hydrochloride.

The nonionic surfactant includes a condensate comprising ethylene oxide and hexylphenol, isooctylphenol, hexadecanol, oleic acid, alkane($C_{12}$–$C_{16}$) thiol, sorbitan monofatty($C_7$–$C_{19}$) acid or alkyl($C_{12}$–$C_{18}$) amine.

A weight ratio of the cationic surfactant to the nonionic surfactant is from 1:9 to 9:1, for example, from 1:9 to 5:5.

The amount of the surfactant may be from 0.01 to 30 parts by weight, for example, from 1 to 20 parts by weight, based on 100 parts by weight of the fluorine-containing polymer.

In the dispersion of fluorine-containing polymer (A), the fluorine-containing polymer is dispersed in water and optionally an organic solvent.

The amount of water is from 70 to 1,900 parts by weight, for example, from 100 to 600 parts by weight, based on 100 parts by weight of the fluorine-containing polymer.

Examples of the organic solvent are ketones such as acetone and methyl ethyl ketone; ethylene glycol derivatives such as ethylene glycol and polyethylene glycol; alkyl ethers of ethylene glycol derivatives such as polyethylene glycol monomethyl ether, polyethylene glycol dimethyl ether, polyethylene glycol monobutyl ether; propylene glycol derivatives such as propylene glycol, dipropylene glycol and polypropylene glycol; polyethers such as cyclodextrin and dexstrin; and esters such as methyl acetate and ethyl acetate.

The amount of the organic solvent is from 0 to 200 parts by weight, for example, from 10 to 100 parts by weight, particularly from 20 to 80 parts by weight, based on 100 parts by weight of the fluorine-containing polymer.

In order to prepare the dispersion of fluorine-containing polymer (A), the polymerizable compound is emulsion-polymerized in water (and optionally the organic solvent) in the presence of the surfactant to give the dispersion of the polymer. Optionally, water and/or the surfactant may be added to the resultant dispersion.

The polymerization temperature may be from 40° C. to 90° C., for example, 45° C. to 60° C. The polymerization time may be from 0.5 hours to 20 hours, for example, from 2 hours to 10 hours.

The amount of the dispersion of fluorine-containing polymer (A) is the balance of deducting the total amount of the foaming agent (B) and the wetting agent (C) (and water-soluble polymer (D)) from 100% by weight of the water-repellent composition.

<Foaming Agent (B)>

The foaming agent (B) may be a compound represented by the formula:

$$R^1—CO—NR^2—(CH_2)_k—X$$

wherein $R^1$ is a $C_{10}$–$C_{22}$ hydrocarbon group, $R^2$ is H or a $C_1$–$C_4$ hydrocarbon group, k is an integer of 1 to 3, and X is $COO^-$, $SO_3^-$ or $PO_4^{2-}$, or the formula:

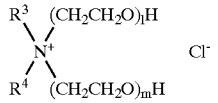

wherein $R^3$ is a $C_{10}$–$C_{22}$ hydrocarbon group, $R^4$ is H or $CH_3$, l is an integer of 1 to 5, and m is an integer of 1 to 5.

Examples of the hydrocarbon group in the formula of the foaming agent (B) include an alkyl group and an alkenyl group.

Particularly, an anionic surfactant such as sodium N-acyl-N-alkyl taurine, sodium N-acyl-N-alkylsarcosine and sodium N-acyl-N-alkylalanine; and a cationic surfactant such as alkyl bis(2-hydroxyethyl)ammonium chloride and alkyl bis(2-hydroxyethyl)methyl ammonium chloride are preferable.

The amount of the foaming agent (B) may be from 0.01 to 0.2% by weight, preferably from 0.02 to 0.15% by weight, based on 100% of the water-repellent composition. When the foaming agent (B) is from 0.01% by weight to 0.2% by weight, the foam is stable, an operation of the coating on the textile is easy and sufficient water-repellency and hydrostatic pressure resistance can be obtained.

<Wetting Agent (C)>

The wetting agent (that is, the penetrating agent) (C) may be alcohols represented by the formula:

$$R^5—OH$$

wherein $R^5$ is a $C_3$–$C_{20}$ hydrocarbon group, or a compound represented by the formula:

$$R^6—(OCH_2CH_2)_n—OR^7$$

wherein $R^6$ is a $C_1$–$C_4$ hydrocarbon group, $R^7$ is H or a $C_1$–$C_4$ hydrocarbon group, and n is an integer of 1 to 4.

Examples of the hydrocarbon group in the formula of the wetting agent (C) include an alkyl group and an alkenyl group.

The alcohols may be a secondary or tertiary alcohol. Among the compounds represented by $R^6—(OCH_2CH_2)_n—OR^7$, particularly preferable are ethylene glycol monomethyl ether, ethylene glycol monoethyl ether, ethylene glycol monopropyl ether, ethylene glycol monobutyl ether, ethylene glycol dimethyl ether, ethylene glycol diethyl ether, ethylene glycol dipropyl ether, ethylene glycol dibutyl ether, diethylene glycol monomethyl ether, diethylene glycol monoethyl ether, diethylene glycol monopropyl ether and diethylene glycol monobutyl ether.

The amount of the wetting agent (C) may be from 0.1 to 30% by weight, preferably from 0.2 to 20% by weight, based on 100% of the water-repellent composition. In the case of the alcohols, the amount of the wetting agent is preferably from 0.1 to 20% by weight, more preferably from 0.2 to 15% by weight, based on 100% of the water-repellent composition. The compound of $R^6—(OCH_2CH_2)_n—OR^7$ is preferably from 3 to 20% by weight, more preferably from 5 to 10% by weight.

<Water-soluble Polymer (D)>

The water-repellent composition of the present invention may also contain a water-soluble polymer (D).

The water-soluble polymer (D) is preferably polyvinyl alcohol (PVA). PVA has a viscosity of 4% aqueous solution at 20° C. of 3 cps to 80 cps, preferably 5 cps to 60 cps. A saponification degree of PVA is preferably from 65 to 90% by mol, more preferably from 70 to 85% by mol.

The amount of the water-soluble polymer (D) in terms of a solid of the water soluble polymer may be from 0 to 0.3% by weight, preferably from 0.03 to 0.1% by weight, based on 100% of the water-repellent composition.

The textile is treated with the water-repellent composition. The textile means any of products made of fibers, such as a fiber, a yarn and a fabric, for example, a woven fabric, a non-woven fabric and a knitted fabric. The textile is made of natural fibers and/or synthetic fibers. Examples of the textile include a hydrophilic textile and a hydrophobic textile. The hydrophobic textile is not particularly limited and examples thereof include a synthetic fiber (for example, fiber of polyolefin such as polypropylene and polyethylene) or a mixture fiber thereof, a yarn, a non-woven fabric, a woven fabric and a knitted fabric.

Examples of the textile include an operation gown (particularly, a disposable operation gown (for example, made of polypropylene)), an operation sheet (for example, made of polypropylene), an industrial material requiring hydrostatic pressure resistance (that is, water penetration resistance), a tent, a boat cover and a vehicular cover.

A method of treating with the water-repellent composition is not limited, includes a method of applying foam generated by foaming process machine (for example, Dynamic Foamer and Static Foamer) to the hydrophobic textile by using a removal exit (an applicator).

The hydrophobic textile treated with the water-repellent composition of the present invention can have improved water-repellency and penetration resistance imparted by thermal treatment. The conditions of the thermal treatment is preferably at the temperature of 90° C. to 130° C., preferably of 100° C. to 120° C. for 1 minute to 5 minutes. When the temperature of the thermal treatment is from 90 to 130° C., the sufficient water-repellency and hydrostatic pressure resistance can be obtained and excessive shrinkage and deterioration of the textile cannot be caused.

PREFERRED EMBODIMENTS OF THE INVENTION

Examples and Comparative Examples are shown hereinafter to illustrate the present invention in detail.

Properties are measured as follows.

Foaming Property

The foam is generated under the following conditions by using a foam processing machine (Model CFS-6, a dynamic foamer manufactured by GASTON COUNTY). The foaming property is evaluated by an expansion ratio and a half life of foam.

Liquid Flow: 150 cc/min.

Air Flow: 1,500 cc/min.

Foamer: 600 rpm

1) The expansion ratio is measured as follows. The foam is poured into a 200 mL glass beaker so to make no gap in the beaker. The protruding foam is cut off by a knife guide and the weight of the foam remaining in the beaker is measured. The expansion ratio is calculated from the equation: Expansion ratio=260/(weight of foam remaining in beaker). The measurement temperature is 25° C. The numerical value of 260 in the equation is a volume (mL) of the beaker.

2) The half life of foam is measured as follows. The foam is poured into a 500 mL separation funnel so to make no gap in the beaker. After the weight of foam poured in the separation funnel is measured, the foam is collapsed and resultant liquid is gradually removed. The half life of foam is taken as the time required for a half of weight of the foam poured into the separation funnel to be removed.

The foaming property is evaluated according to the following criteria.

Good: Expansion ratio is at least 10, and half life of foam is at least 1 minute and 30 seconds Bad: Expansion ratio is less than 10, or half life of foam is less than 1 minute and 30 seconds Water-repellency The water-repellency is determined by a water/alcohol drop method. Several drops of a test liquid shown in the following Table 1 are dropped onto three positions of a test fabric. After 30 seconds, the penetration state is observed. The maximum point at which the test solution exhibits no penetration is expressed by the water-repellency.

TABLE 1

| Water-repellency | Mixing ratio of water and isopropyl alcohol (IPA) (vol/vol) |
|---|---|
| W | Water 100 |
| 1 | 90/10 Water/IPA |
| 2 | 80/20 Water/IPA |
| 3 | 70/30 Water/IPA |
| 4 | 60/40 Water/IPA |
| 5 | 50/50 Water/IPA |
| 6 | 40/60 Water/IPA |
| 7 | 30/70 Water/IPA |
| 8 | 20/80 Water/IPA |
| 9 | 10/90 Water/IPA |
| 10 | IPA 100 |

Hydrostatic Pressure Resistance

Hydrostatic pressure resistance is measured according to AATCC 127. An average of n=5 is taken as the hydrostatic pressure resistance.

PREPARATIVE EXAMPLE 1

Preparation of Dispersion of Fluorine-containing Polymer

Into a 1 L autoclave, $C_nF_{2n+1}CH_2CH_2OCOCH{=}CH_2$ (a mixture wherein n is 6, 8, 10, 12 and 14: average of n is 8) (100 g), stearyl acrylate (8 g), N-methylol acrylamide (4 g), pure water (245 g), tripropylene glycol (40 g), acetic acid (0.7 g), di-harden tallow dimethyl ammonium chloride (3 g), polyoxyethylene lauryl ether (10 g) were charged and emulsified by an ultrasonic at 60° C. for 15 minutes while stirring. After the emulsification, the emulsion was cooled to 35° C., vinyl chloride (37 g) and 2,2-azobis(2-methylpropionamidine) dihydrochloride (1 g) were added and the reaction was conducted for 5 hours to give a dispersion of a fluorine-containing polymer (a perfluoroalkyl group-containing polymer).

EXAMPLES 1 to 8

Comparative Examples 1 to 4

A water-repellent composition having the components shown in Table 2 was prepared. The foaming property of the water-repellent composition was evaluated.

Foam generated from the water-repellent composition by a foam processing machine (Dynamic Foamer) was uniformly adhered and penetrated by an applicator into a polypropylene non-woven fabric (SMS structure) to have a wet pick up of 40%.

The wet pick up is calculated from the following formula:

$$\text{Wet pick up}=100\times(W_2-W_1)/W_1$$

wherein $W_1$: weight of fabric before immersion, $W_2$: weight of fabric after immersion.

Then, after the fabric is thermally treated with a tenter at 110° C. for 2 minutes, water-repellency and hydrostatic pressure resistance were evaluated. The results are shown in Table 2.

Effect of the Invention

Since the water-repellent composition of the present invention has sufficient foaming property in a foaming process, the foaming process can be easily conducted. The water-repellent composition of the present invention can impart high water-repellency and penetration resistance to a textile.

What is claimed is:

1. A water-repellent composition for foaming process of a hydrophobic textile comprising:

(A) a dispersion of a fluorine-containing polymer, (B) a foaming agent, and (C) a wetting agent.

2. The water-repellent composition according to claim 1, wherein the foaming agent (B) is a compound represented by the formula:

$$R^1—CO—NR^2—(CH_2)_k—X$$

wherein $R^1$ is a $C_{10}$–$C_{22}$ hydrocarbon group, $R^2$ is H or a $C_1$–$C_4$ hydrocarbon group, k is an integer of 1 to 3, and X is $COO^-$, $SO_3^-$ or $PO_4^{2-}$.

3. The water-repellent composition according to claim 1, wherein the foaming agent (B) is a compound represented by the formula:

TABLE 2

| | Examples | | | | | | | | Com. Ex. | | |
|---|---|---|---|---|---|---|---|---|---|---|---|
| Amount (% by weight) | 1 | 2 | 3 | 4 | 5 | 6 | 7 | 8 | 1 | 2 | 3 |
| Perfluoroalkyl group-containing polymer | 3 | 4 | 5 | 6 | 7 | 4 | 5 | 4 | 4 | 4 | — |
| Foaming agent | | | | | | | | | | | |
| N-lauroyl-N-methyllaurin Na | 0.07 | — | — | — | 0.05 | 0.03 | 0.03 | 0.05 | — | 0.05 | 0.05 |
| N-lauroyl-N-methylsarcosine Na | — | 0.06 | — | — | — | — | — | — | — | — | — |
| N-lauroyl-N-methylalanine Na | — | — | 0.05 | — | — | — | — | — | — | — | — |
| Cocobis (2-hydroxyethyl)-methyl ammonium chloride | — | — | — | 0.03 | — | — | — | — | — | — | — |
| Wetting agent | | | | | | | | | | | |
| Octanol | 0.5 | 0.4 | 0.3 | 0.4 | — | — | — | 0.3 | 0.3 | — | 0.3 |
| Hexanol | — | — | — | — | 0.6 | — | — | — | — | — | — |
| Ethylene glycol butyl-ether | — | — | — | — | — | 6 | — | — | — | — | — |
| Ethylene glycol propyl ether | — | — | — | — | — | — | 8 | — | — | — | — |
| Water-soluble polymer | | | | | | | | | | | |
| PVA (saponification degree: 80 mol %, viscosity: 49 cps) | — | — | — | — | — | — | — | 0.03 | — | — | — |
| Water | 96.43 | 95.54 | 94.65 | 95.57 | 95.35 | 89.97 | 87.94 | 95.65 | 95.7 | 95.95 | 99.65 |
| Foaming property | | | | | | | | | | | |
| Dynamic Foamer property | Good | Good | Good | Good | Good | Good | Good | Good | Bad | Good | Bad |
| Water-repellency | | | | | | | | | | | |
| IPA/Water drop method | 7 | 8 | 8 | 5 | 8 | 8 | 7 | 10 | — | 3 | 1 |
| Hydrostatic pressure resistance | | | | | | | | | | | |
| AATCC 127 | 660 | 650 | 630 | 600 | 650 | 610 | 600 | 660 | — | 700 | 250 |

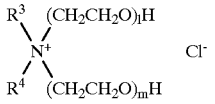

wherein $R^3$ is a $C_{10}$–$C_{22}$ hydrocarbon group, $R^4$ is H or $CH_3$, 1 is an integer of 1 to 5, and m is an integer of 1 to 5.

4. The water-repellent composition according to claim 1, wherein the wetting agent (C) is a compound represented by the formula:

$$R^5—OH$$

wherein $R^5$ is a $C_3$–$C_{20}$ hydrocarbon group.

5. The water-repellent composition according to claim 1, wherein the wetting agent (C) is represented by the formula:

$$R^6—(OCH_2CH_2)_n—OR^7$$

wherein $R^6$ is a $C_1$–$C_4$ hydrocarbon group, $R^7$ is H or a $C_1$–$C_4$ hydrocarbon group, and n is an integer of 1 to 4.

6. The water-repellent composition according to claim 1, which further contains (D) a water-soluble polymer.

7. The water-repellent composition according to claim 6, wherein the water-soluble polymer (D) is polyvinyl alcohol.

8. A textile which is treated with the water-repellent composition according to claim 1.

* * * * *